US012078031B2

(12) United States Patent
Park

(10) Patent No.: US 12,078,031 B2
(45) Date of Patent: Sep. 3, 2024

(54) DEEP GAS LIFT

(71) Applicant: Schlumberger Technology Corporation, Sugar Land, TX (US)

(72) Inventor: Jonathan Park, Tananger (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/251,143

(22) PCT Filed: Oct. 29, 2021

(86) PCT No.: PCT/US2021/057377
§ 371 (c)(1),
(2) Date: Apr. 28, 2023

(87) PCT Pub. No.: WO2022/094292
PCT Pub. Date: May 5, 2022

(65) Prior Publication Data
US 2023/0407727 A1 Dec. 21, 2023

Related U.S. Application Data

(60) Provisional application No. 63/107,491, filed on Oct. 30, 2020.

(51) Int. Cl.

| | |
|---|---|
| ***E21B 33/12*** | (2006.01) |
| ***E21B 41/00*** | (2006.01) |
| ***E21B 43/12*** | (2006.01) |
| ***E21B 43/14*** | (2006.01) |

(52) U.S. Cl.
CPC ..... *E21B 41/0035* (2013.01); *E21B 43/122* (2013.01); *E21B 43/14* (2013.01)

(58) Field of Classification Search
CPC ..... E21B 41/0035; E21B 43/122; E21B 43/14
See application file for complete search history.

(56) References Cited

U.S. PATENT DOCUMENTS

| | | | | |
|---|---|---|---|---|
| 6,298,918 | B1 | 10/2001 | Franco et al. | |
| 10,697,278 | B2 | 6/2020 | Elmer | |
| 2003/0178205 | A1* | 9/2003 | Henderson | E21B 41/0085 166/387 |
| 2005/0103497 | A1 | 5/2005 | Gondouin | |
| 2005/0252689 | A1 | 11/2005 | Gardes | |
| 2010/0126729 | A1 | 5/2010 | Tunget | |
| 2010/0163235 | A1* | 7/2010 | Mootoo | E21B 21/10 166/278 |
| 2013/0112408 | A1* | 5/2013 | Oxtoby | E21B 33/12 166/250.17 |
| 2015/0075781 | A1* | 3/2015 | Buechler | E21B 43/16 166/305.1 |
| 2016/0186544 | A1* | 6/2016 | Greci | E21B 43/16 166/305.1 |
| 2019/0100975 | A1* | 4/2019 | Frazee | E21B 17/023 |
| 2023/0304372 | A1* | 9/2023 | Raglin | E21B 33/1208 |

OTHER PUBLICATIONS

International Search Report and Written Opionion issued in PCT Application PCT/US2021/057377, dated Feb. 14, 2022 (17 pages).

* cited by examiner

*Primary Examiner* — Taras P Bemko
(74) *Attorney, Agent, or Firm* — Jeffrey D. Frantz

(57) ABSTRACT

Systems and methods for gas lift in the main bore and lateral legs of a multilateral well. The systems and methods can allow for gas lift below the junction of a multilateral well.

17 Claims, 4 Drawing Sheets

DEEP GAS LIFT

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application is a National Stage of International Application No. PCT/US2021/057377, filed Oct. 29, 2021 which claims priority benefit of U.S. Provisional Application No. 63/107,491, filed Oct. 30, 2020, the entirety of which is incorporated by reference herein and should be considered part of this specification.

BACKGROUND

Field

The present disclosure generally relates to gas lift in multilateral wells.

Description of the Related Art

Oil and gas wells utilize a borehole drilled into the earth and subsequently completed with equipment to facilitate production of desired fluids from a reservoir. Subterranean fluids, such as oil, gas, and water, are produced from the wellbore. In some cases, the fluid is produced to the surface naturally by downhole formation pressures. However, the fluid must often be artificially lifted from wellbores by the introduction of downhole equipment. Various types of artificial lift are available. In a gas lift system, a compressor is located on the surface. The compressor pumps gas down the casing tubing annulus. The gas is then released into the production tubing via gas valves that are strategically placed throughout the production tubing. The gas that is introduced lightens the hydrostatic weight of the fluid in the production tubing, allowing the reservoir pressure to lift the fluid to surface.

SUMMARY

The present disclosure provides systems and methods for gas lift in the main bore and lateral legs of a multilateral well. The present disclosure provides systems and methods for gas lift below the junction of a multilateral well.

In some configurations, a bypass packer configured for use in a gas lift system in a multilateral well includes a through bore configured to receive tubing, the tubing configured to carry produced oil to the surface in use; and the bypass packer configured to receive gas from an annulus between the tubing and a well casing and transfer the gas into a gas tube extending from the bypass packer in use. In some configurations, a Y-block configured for use in a gas lift system in a multilateral well is configured to receive a production tubing and split the production tubing into two tubing strings; and receive a gas tube and split the gas tube into two gas tubes. In some configurations, a gas tube for use in a gas lift system in a multilateral well has an oval, crescent, or arch shaped transverse cross-section. In some configurations, a lateral bypass packer for use in a gas lift system in a multilateral well is configured to transfer gas from a gas tube to an annulus between a production tubing and a well casing. A gas lift system for a multilateral well can include the bypass packer, the Y-block, the gas tube, and/or the lateral bypass packer.

In some configurations, a multilateral gas lift system includes a main production tubing configured to transport produced oil flow uphole; a main bore assembly comprising a main bore tubing; a lateral bore assembly comprising a lateral bore tubing; a Y-block configured to combine produced oil flow from the main bore tubing and the lateral bore tubing into the main production tubing; and a gas lift system configured to allow for gas lift in either or both of the main bore and the lateral bore.

The gas lift system can include one or more gas lift valves disposed along the main bore tubing and/or the lateral bore tubing. The system can further include a main gas tube or passageway extending axially through the Y-block and two gas tubes extending downhole from the Y-block, one of the two gas tubes associated with and extending parallel to each of the main bore tubing and the lateral bore tubing, the Y-block configured to separate injected gas flowing through the main gas tube or passageway into the two gas tubes. Each of the two gas tubes can have a crescent or arch shaped transverse cross-section. Each of the two gas tubes can curve about a portion of an outer circumference of the main bore tubing or the lateral bore tubing.

The system can further include a bypass packer disposed uphole of the Y-block. The main production tubing can extend through the bypass packer. The system can further include a gas tube or passageway extending through the bypass packer. Gas injected by the gas lift system can be configured to flow from an annulus outside of the main production tubing into the gas tube or passageway extending through the bypass packer. The gas tube or passageway can extend downhole from the bypass packer to a main gas tube or passageway extending axially through the Y-block.

In some configurations, a gas lift method includes injecting gas into an annulus between a casing and a tubing of a multilateral well such that the gas flows into both an annulus of a main bore of the multilateral well and an annulus of at least one lateral leg of the multilateral well; and releasing the gas into production tubing of the main bore and/or into production tubing of the at least one lateral leg.

The method can include directing the gas from the annulus into a gas tube extending through a bypass packer and into a Y-block disposed at or near a junction of the multilateral well. The method can further include splitting the gas flow entering the Y-block into at least two gas tubes, one of the gas tubes associated with and extending parallel to a tubing of the main bore and another of the gas tubes associated with and extending parallel to a tubing of the lateral leg. The method can further include releasing gas from the gas tubes into an annulus of the main bore and an annulus of the lateral leg downhole of packers disposed in the main bore and the lateral leg.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Figure 1:
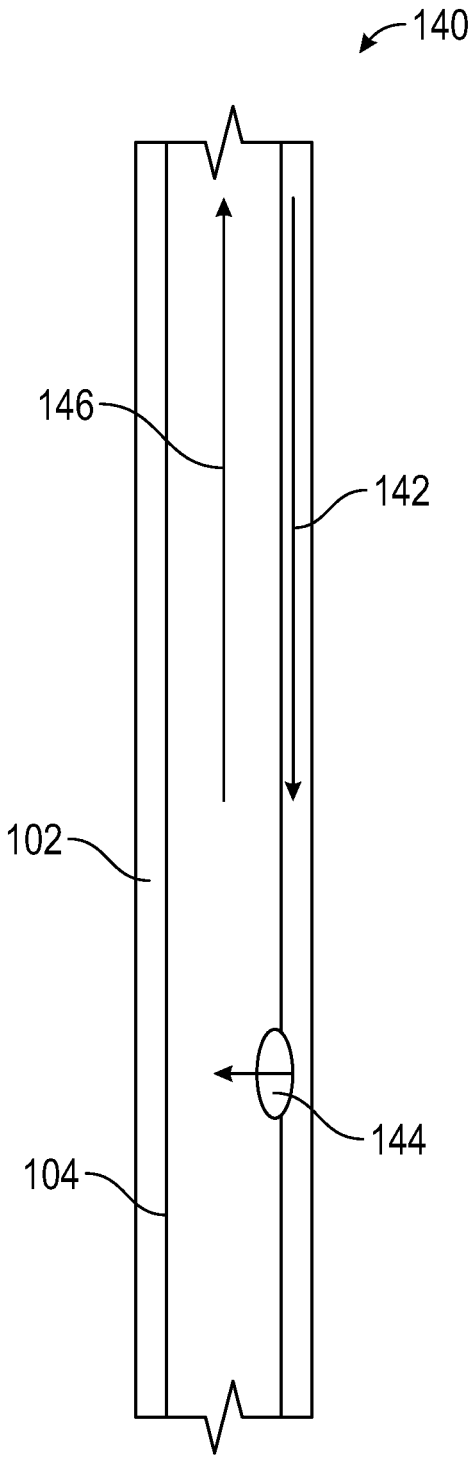
FIG. 1 illustrates a portion of an example standard gas lift system.

FIG. 1 illustrates a downhole portion of an example gas lift system 140. The gas lift system 140 includes a compressor located at the well surface. In use, the compressor pumps gas down the annulus between the casing 102 and the tubing 104, as indicated by arrow 142. The gas is then released into the tubing 104 via one or more gas valves 144 that are strategically placed throughout the tubing 104. The gas lessens the hydrostatic weight of the fluid in the tubing 104, allowing the reservoir pressure to lift the fluid to the surface, as indicated by arrow 146.

Systems and methods according to the present disclosure advantageously allow for gas lift from both the main bore and lateral leg(s) of a multilateral well. Systems and methods according to the present disclosure advantageously allow for gas lift below the junction of a multilateral well, which can allow the junction to be located higher in the wellbore.

Figure 2:
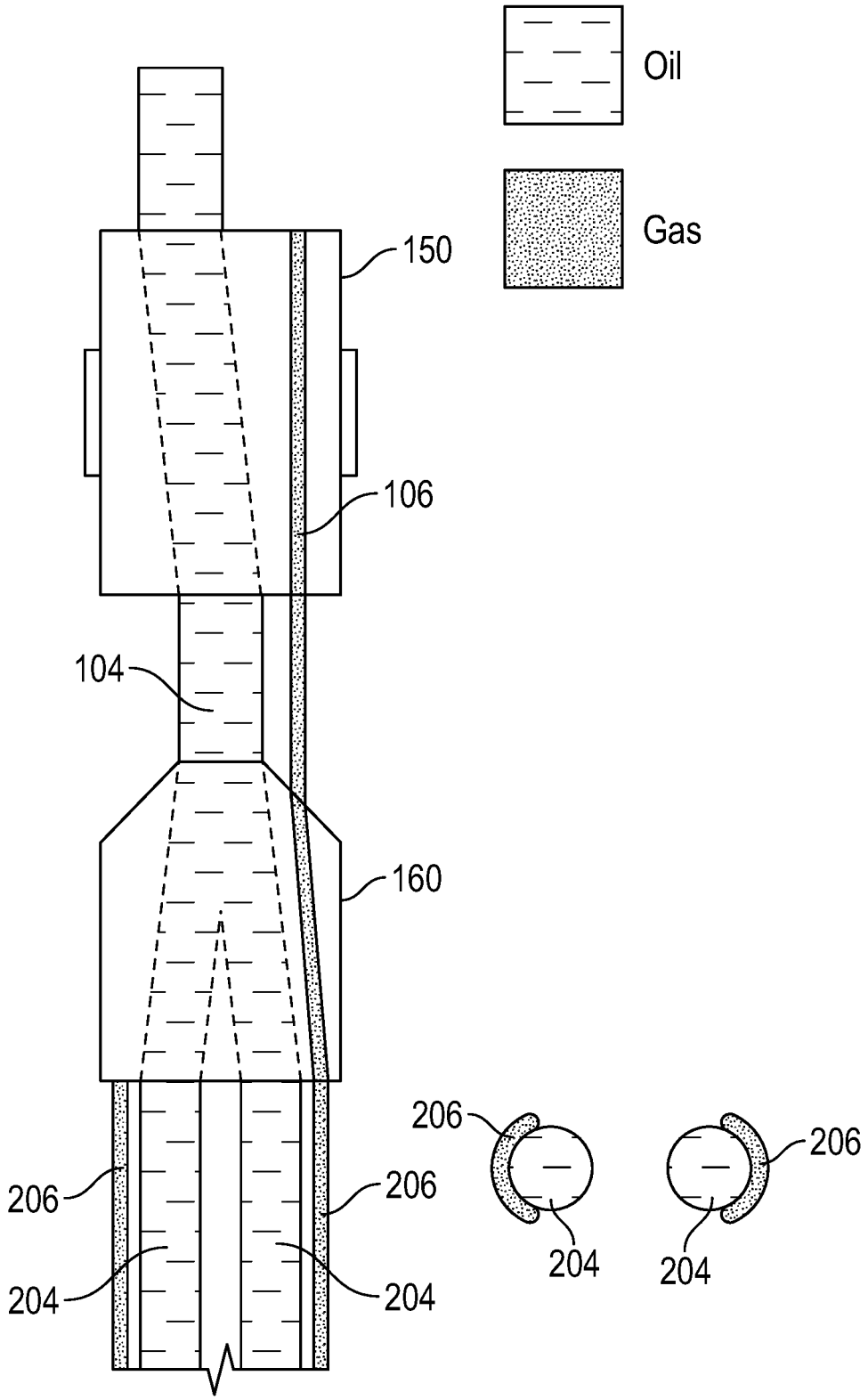
FIG. 2 illustrates a portion of an example multilateral gas lift system.
Figure 3:
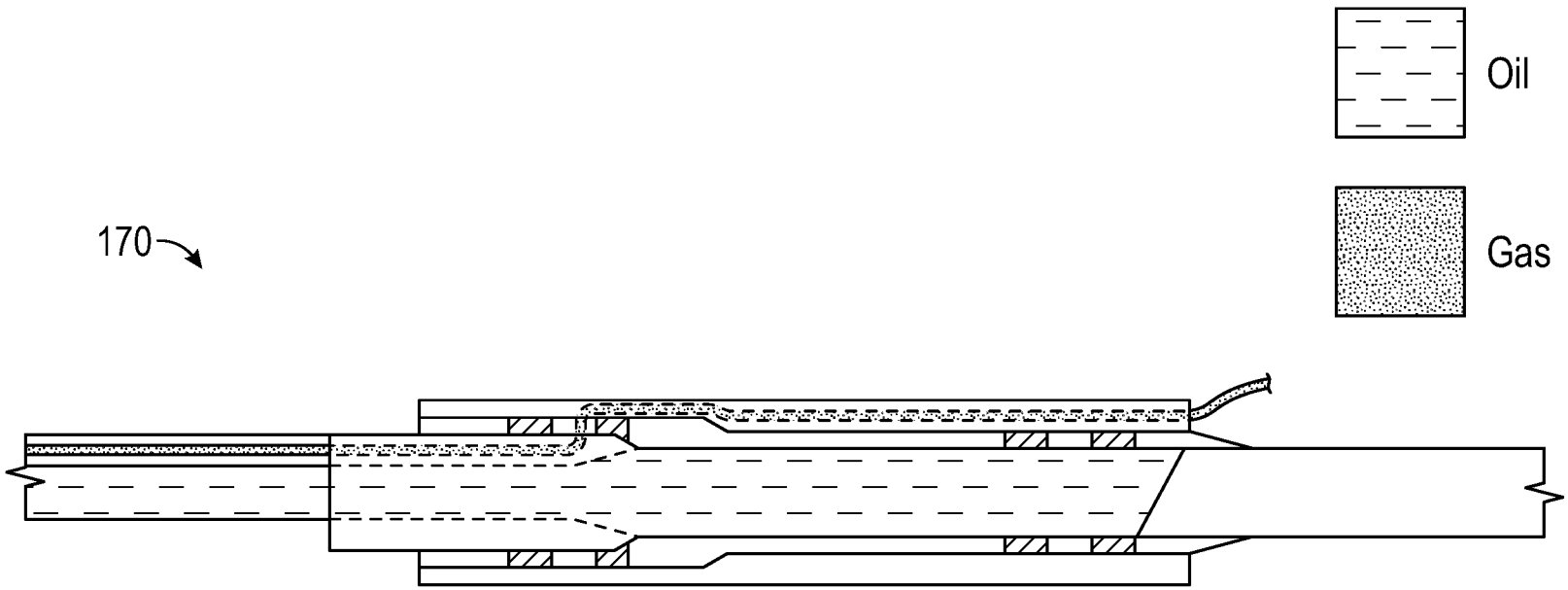
FIG. 3 illustrates a portion of an example multilateral gas lift system.
Figure 4:
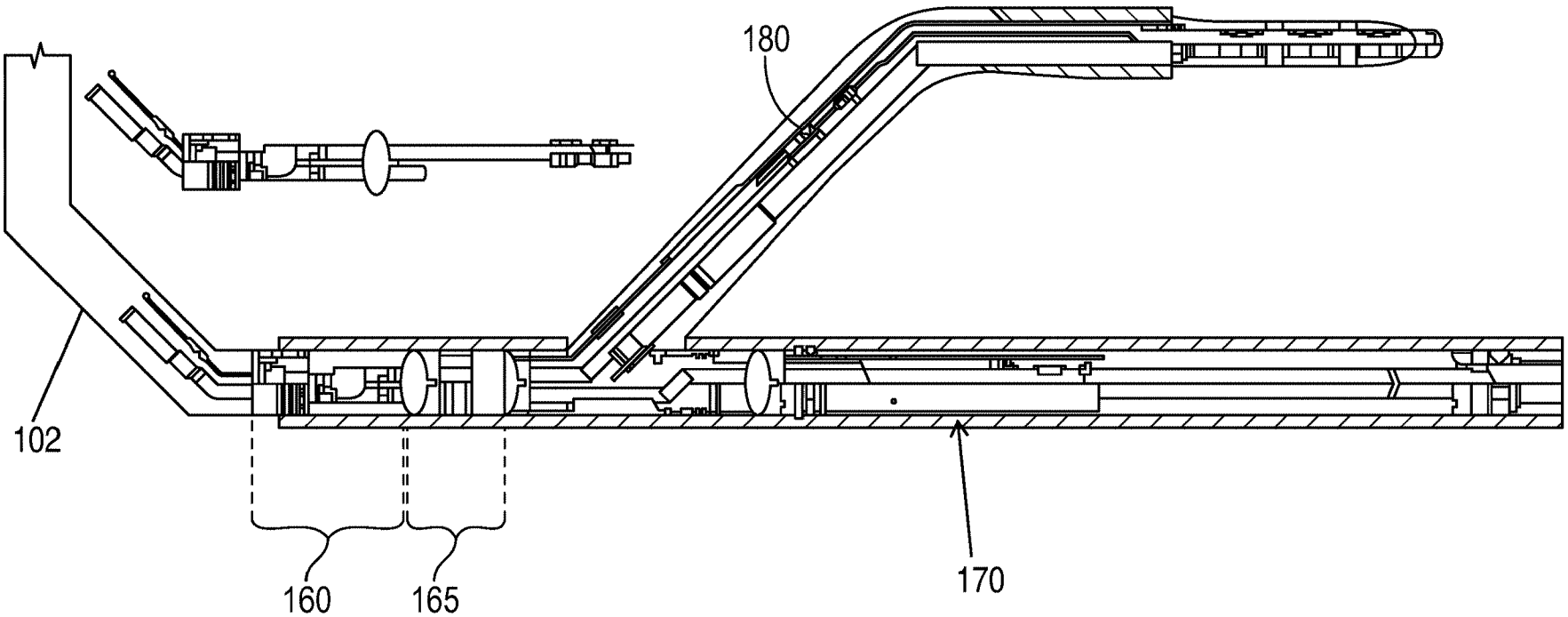
FIG. 4 illustrates an example multilateral well including a gas lift system.

As shown in FIGS. 2-4, a multilateral system according to the present disclosure can include a bypass packer 150, a Y-block 160, a gas tube 106 configured to carry injected gas downhole, and/or a no go seal assembly 170. The Y-block 160 is positioned at, near, and/or downstream (with respect to produced oil flow) of the junction 165. The Y-block 160 combines flow (e.g., oil flow) from two or more strings (e.g., the main bore and a lateral leg) into the main production tubing 104 and/or splits flow (e.g., injected gas flow) from one into two or more strings. As shown in FIG. 2, within the Y-block 160, the main production tubing 104, configured to carry produced oil uphole, can split into two tubing strings 204, for example, a main tubing string and a lateral leg.

The bypass packer 150 can be positioned downstream (with respect to produced oil flow) or uphole of the Y-block 160. As shown, the main gas tube 106 extends through at least a portion of the bypass packer 150, from the bypass packer 150 downhole to the Y-block 160, and through at least a portion of the Y-block 160. The bypass packer 150 transfers injected gas from the annulus to the main gas tube 106. In other words, gas injected from the surface flows downhole through the annulus to the bypass packer 150, then flows into and through the main gas tube 106 at the bypass packer 150. Within the Y-block 160, the main gas tube 106 can split into two or more gas tubes 206. One of the gas tubes 206 can be associated with each of the tubing strings 204.

In some configurations, the gas tubes 206 have an oval or crescent transverse cross-sectional shape. The oval or crescent cross-sectional shape can allow each of the gas tubes 206 to partially encircle or curve around one of the tubing strings 204. The oval or crescent cross-sectional shape can advantageously maximize flow area for the gas, for example, while reducing the overall cross-section of and space needed for the Y-block 160 and/or the combination of one of the tubing strings 204 with one of the gas tubes 206 as the tubing strings and gas tubes extend upstream (relative to produced oil flow) in the main bore or a lateral leg. In some configurations, only a portion of a total length of the gas tubes 206 has the oval or crescent cross-sectional shape. For example, only a portion of the gas tubes 206 stoking through the DTLA (dual tubing locating assembly) may have an oval or crescent cross-sectional shape.

The main bore can include a no go sealbore and seal assembly as shown in FIG. 3. The assembly can include or allow for cross-flow. The assembly can allow gas from the main bore gas tube 206 to flow into the annulus below or downhole of the assembly to allow for standard gas lift operation below the assembly.

The system can further include a lateral bypass packer 180, for example, in the lateral leg. The lateral bypass packer 180 transfers gas from the gas tube 206 extending in the lateral leg to the annulus below or downhole of the packer 180 to allow for standard gas lift operation below the packer 180.

Each of the main bore and lateral leg(s) can include one or more gas lift valves 144. The gas lift valve(s) 144 can be disposed along tubing of the main bore and lateral leg(s) and configured to selectively release injected gas into the tubing to allow for gas lift in one or more of the main bore and lateral leg(s).

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A gas lift system for a multilateral well, comprising:

a bypass packer comprising a through bore configured to receive tubing, wherein the bypass packer is configured to expand to isolate a first portion of an annulus between the tubing and a well casing uphole of the bypass packer from a second portion of the annulus downhole of the bypass packer; and a gas tube configured to receive a gas from the first portion of the annulus, the gas tube comprising:

a first portion disposed in the bypass packer, the first portion of the gas tube comprising an inlet at an uphole end of the bypass packer, the inlet of the gas tube in fluid communication with the first portion of the annulus; and a second portion extending from a downhole end of the bypass packer and disposed in the second portion of the annulus.

2. The gas lift system of claim 1, further comprising a Y-block, wherein the second portion of the gas tube is disposed in the Y-block.

3. The gas lift system of claim 2, wherein the Y-block splits the second portion of the gas tube into a first gas tube and a second gas tube.

4. The gas lift system of claim 1, further comprising one or more gas lift valves disposed along the main production tubing uphole of the bypass packer.

5. A multilateral gas lift system comprising:

a main production tubing configured to transport produced oil flow uphole;

a first lateral bore tubing;

a second lateral bore tubing;

a bypass packer configured to isolate a first portion of an annulus between the main production tubing and a well casing uphole of the bypass packer from a second portion of the annulus downhole of the bypass packer;

a main gas tube comprising:

a first portion disposed in the bypass packer, the first portion of the main gas tube comprising an inlet at an uphole end of the bypass packer, wherein the inlet of the main gas tube is in fluid communication with the first portion of the annulus; and a second portion extending from a downhole end of the bypass packer and disposed in the second portion of the annulus;

a Y-block configured to combine produced oil flow from the first lateral bore tubing and the second lateral bore tubing into the main production tubing, wherein the second portion of the main gas tube extends between the bypass packer and the Y-block and wherein the second portion of the main gas tube splits into a first gas tube and a second gas tube in the Y-block; and a gas lift system configured to allow for gas lift in either or both of the first lateral bore tubing and the second lateral bore tubing.

6. The system of claim 5, the gas lift system comprising one or more gas lift valves disposed along the first lateral bore tubing.

7. The system of claim 5, the gas lift system comprising one or more gas lift valves disposed along the second lateral bore tubing.

8. The system of claim 5, wherein:

the first gas tube and the second gas tube extend downhole from the Y-block; and the first gas tube extends parallel to the first lateral bore tubing and the second gas tube extends parallel to the second lateral bore tubing; and the Y-block is configured to separate injected gas flowing through the second portion of the main gas tube into the first gas tube and the second gas tube.

9. The system of claim 8, wherein the first gas tube and the second gas tube each comprise a crescent or arch shaped transverse cross-section.

10. The system of claim 9, wherein the first gas tube curves about a portion of an outer circumference of the first lateral bore tubing and the second gas tube curves about a portion of an outer circumference of the second lateral bore tubing.

11. The system of claim 5, wherein gas injected by the gas lift system flows from the first portion of the annulus into the main gas tube.

12. A gas lift method comprising:

injecting a gas into a first portion of a first annulus uphole of a bypass packer and between a well casing and a main production tubing of a multilateral well, wherein the main production tubing is coupled to a first production tubing disposed in a first lateral leg and a second production tubing disposed in a second lateral leg; and transferring the gas from the first portion of the first annulus into a first gas tube disposed in a second annulus between the first production tubing and the well casing and into a second gas tube disposed in a third annulus between the second production tubing and the well casing via a main gas tube in communication with the first portion of the first annulus and the first gas tube and the second gas tube, wherein a first portion of the main gas tube is disposed in the bypass packer and a second portion of the main gas tube is disposed in a second portion of the first annulus downhole of the bypass packer.

13. The method of claim 12, wherein the second portion of the main gas tube is disposed in a Y-block, wherein the Y-block fluidly couples the main production tubing to the first production tubing and the second production tubing.

14. The method of claim 12, further comprising releasing gas from the first gas tube into the second annulus.

15. The method of claim 12, further comprising releasing gas into the main production tubing.

16. The method of claim 15, wherein releasing gas into the main production tubing comprises releasing gas into the main production tubing uphole of the bypass packer.

17. The method of claim 12, further comprising releasing the gas from the second gas tube into the third annulus.

* * * * *